US005598737A

United States Patent [19]

Oide

[11] Patent Number: 5,598,737

[45] Date of Patent: Feb. 4, 1997

[54] PORTABLE, POWER DRIVEN PUNCH PRESS FOR WORKING ON STEEL FRAME MEMBERS

[75] Inventor: Eisuke Oide, Yokohama, Japan

[73] Assignee: Kabushiki Kaisha Ogura, Japan

[21] Appl. No.: 348,241

[22] Filed: Nov. 28, 1994

[30] Foreign Application Priority Data

Dec. 3, 1993 [JP] Japan ..... 5-304276
Mar. 16, 1994 [JP] Japan ..... 6-046103

[51] Int. Cl.[6] ..... B26B 17/00

[52] U.S. Cl. ..... 72/453.01; 72/453.15; 30/180; 30/228; 83/917

[58] Field of Search ..... 72/453.15, 453.16, 72/453.01; 29/750, 751, 753; 30/180, 228, 210; 83/639.1, 917

[56] References Cited

U.S. PATENT DOCUMENTS

| | | | |
|---|---|---|---|
| 2,296,501 | 9/1942 | Pocock et al. . | |
| 2,557,265 | 6/1951 | Denison, Jr. . | |
| 2,967,355 | 1/1961 | Yermish | 30/228 |
| 3,002,576 | 2/1962 | Daman | 30/228 |
| 3,111,869 | 11/1963 | Goff et al. . | |
| 3,455,196 | 7/1969 | Kreider | 83/917 |
| 3,733,699 | 5/1973 | Bock | 30/180 |
| 4,140,001 | 2/1979 | Moulton . | |
| 4,201,130 | 5/1980 | Stahl . | |
| 4,382,331 | 5/1983 | Kimura | 30/180 |
| 4,667,411 | 5/1987 | McCallum . | |
| 4,986,154 | 1/1991 | Vernacchio | 83/917 |
| 5,111,681 | 5/1992 | Yasui et al. | 72/453.15 |
| 5,282,378 | 2/1994 | Kimura | 72/453.15 |

FOREIGN PATENT DOCUMENTS

| | | | |
|---|---|---|---|
| 2607041 | 5/1988 | France . | |
| 230518 | 11/1908 | Germany . | |
| 8313870 | 10/1988 | Germany . | |
| 63-138921 | 9/1988 | Japan . | |
| 200467 | 7/1967 | U.S.S.R. | 72/453.15 |
| 856176 | 12/1960 | United Kingdom . | |
| 1164308 | 9/1969 | United Kingdom . | |
| 1485795 | 9/1977 | United Kingdom . | |

*Primary Examiner*—David Jones
*Attorney, Agent, or Firm*—Dickstein Shapiro; Morin & Oshinsky LLP

[57] ABSTRACT

A portable punch press suitable for bending, cutting or otherwise working on steel frame members at sites of construction. Included is a C shaped frame erected on a bed for upstandingly carrying a hydraulic cylinder in overlying relationship to the bed. A replaceable die assembly is mounted on the bed so as to be acted upon by the hydraulic cylinder a for working on a desired blank. A pump for supplying a pressurized fluid to the cylinder is mounted thereon and driven by an electric motor disposed behind the pump. The pump and its drive motor are disposed in horizontal alignment for reduction of the total height of the machine, so that a steel frame member can be bent into a rectangular frame of less size than heretofore. In another embodiment the die assembly is modified to include a drive linkage such that the dies are disposed out of vertical register with the cylinder, thereby making possible the production of rectangular frames of further reduced size.

12 Claims, 16 Drawing Sheets

PORTABLE, POWER DRIVEN PUNCH PRESS FOR WORKING ON STEEL FRAME MEMBERS

BACKGROUND OF THE INVENTION

This invention relates to punch presses in general and, in particular, to a portable, power driven punch press suitable for bending, cutting, perforating, or otherwise working on steel frame members at sites of construction.

Hydraulic punch presses of the kind under consideration were long separate from hydraulic power units comprising a pump and a drive motor. The pump was communicated with the press via a flexible conduit system. Such conventional punch press systems were difficult of handling, particularly at construction sites where they had to be often carried from one place to another. Another objection to such known machines is that their frames, comprised of four columns in some instances, can interfere with the loading, unloading, and punching of blanks of bulky size or complex shape.

In order to remedy these drawbacks Japanese Unexamined Utility Model Publication No. 63-138921 suggests an integrated hydraulic punch press in which the hydraulic power unit is coupled directly to a hydraulic cylinder. This punch press also features a frame that is in the shape of a C when the press is seen in a side view, with the hydraulic cylinder mounted upstandingly to the upper horizontal limb, or overarm, of the C frame. The portability of this integrated punch press is of course much better than that of the more conventional one. Its operability is greatly enhanced, too. Since the C frame is open both forwardly and laterally of the machine, the blank can be loaded and unloaded from the front of the press.

The known integrated punch press has its own weaknesses, however. The machine was devoted exclusively to the creation of holes, so that additional machines had to be brought to construction sites for other operations such as cutting and bending.

Another disadvantage arose from the fact that the hydraulic power unit was disposed vertically in line with the hydraulic cylinder, adding substantially to the total height of the machine. The tall punch press brings about an inconvenience when it is modified to perform bending. Assume that an L sectioned steel strip is to be bent at right angles at three longitudinally spaced points thereon into a rectangular frame, as is frequency required at construction sites. Then, depending upon the frame size required, the upstanding hydraulic power unit may interfere with the blank during the bending of the last point thereon.

SUMMARY OF THE INVENTION

The present invention seeks, therefore, to enhance the versatility and operability of the punch presses of the kind defined, providing an improved punch press that can perform a variety of punching operations and which lends itself to use, among other applications, for bending a is steel strip into a rectangular frame of less size than heretofore.

Briefly, the invention may be summarized as a punch press for bending, cutting, boring, or otherwise working on blanks such as steel frame members at sites of construction, among other applications. The punch comprises frame means including a bed to be laid horizontally, a fluid actuated cylinder mounted vertically to the frame means in overlying relationship to the bed and having a piston rod directed downwardly, pump means disposed atop the fluid actuated cylinder for supplying pressurized fluid thereto, the pump means being generally disposed horizontally for reduction of the total height of the punch press, and die means mounted on the bed in order to be acted upon by the piston rod of the fluid actuated cylinder for working on a desired blank.

Typically, the pump means is a combination of a hydraulic pump and an electric drive motor therefor. The pump and the drive motor are disposed in horizontal axial alignment, so that the machine height is much less than heretofore.

According to another feature of the invention, the die means takes the form of a variety of interchangeable die assemblies which can be readily mounted to and dismounted from the machine. The punch press can perform bending, cutting, notching, and a variety of other operations merely by changing the die assemblies.

The invention also features a drive linkage for transmitting the movement of the piston rod of the fluid actuated cylinder to the die means. The drive linkage, typically including a drive arm, is generally elongated horizontally so that the die means can be disposed out of vertical alignment with the fluid actuated cylinder. The drive linkage makes possible the production of rectangular frames of much smaller size than the machine height, there being practically no interfering part overlying the die means. As an additional advantage, how far the die means is to be disposed out of vertical alignment with the fluid actuated cylinder depends solely upon the length of the drive arm, so that an optimum distance may be determined to suit each particular punching operation and particular blanks to be punched.

The above and other features and advantages of this invention and the manner of realizing them will become more apparent, and the invention itself will best be understood, from a study of the following description and appended claims, with reference had to the attached drawings showing the preferred embodiments of the invention.

DESCRIPTION OF THE PREFERRED EMBODIMENTS

Figure 1:
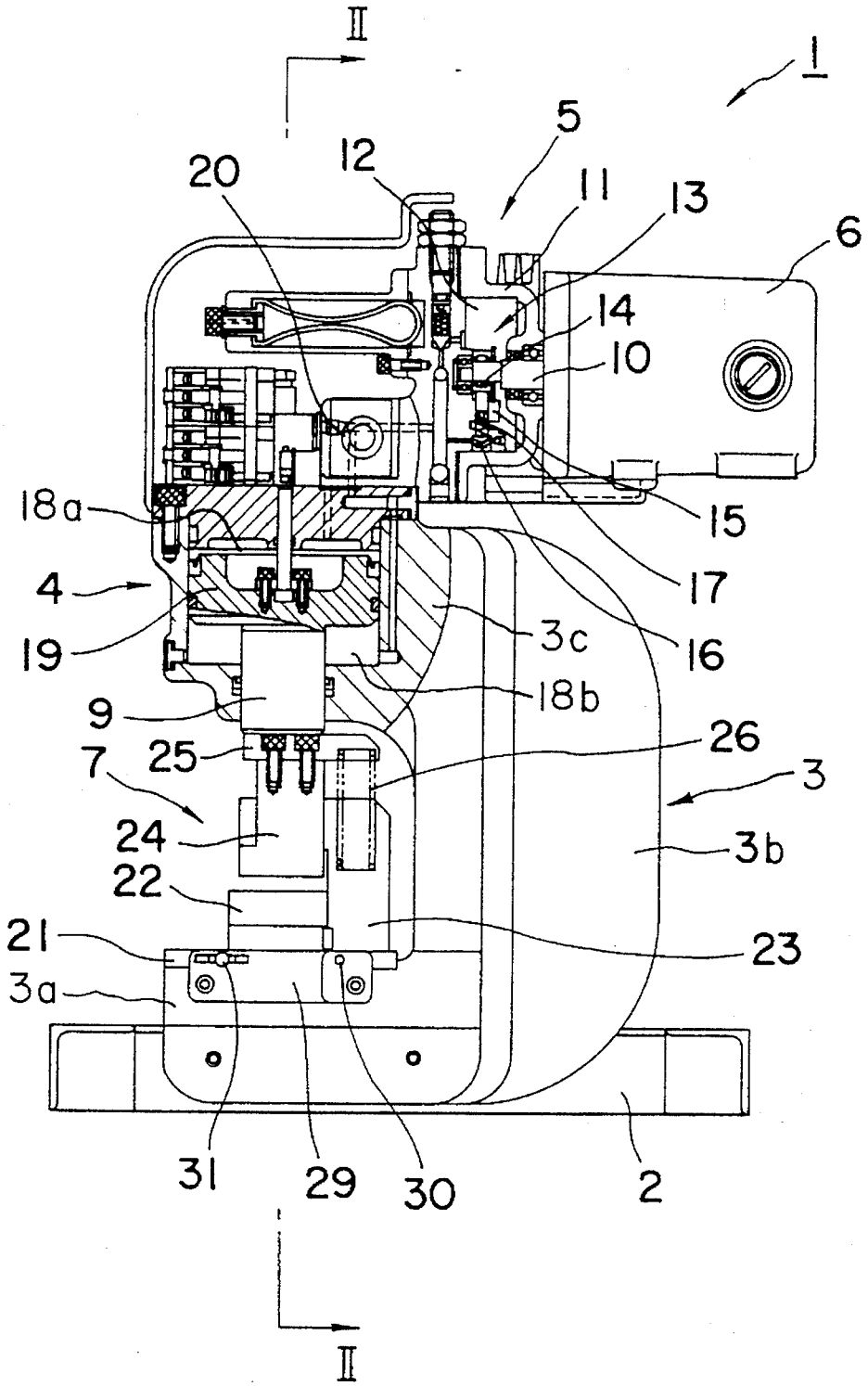
FIG. 1 is a side elevation, partly sectioned for clarity, of the punch press constructed in accordance with the novel concepts of this invention.
Figure 2:
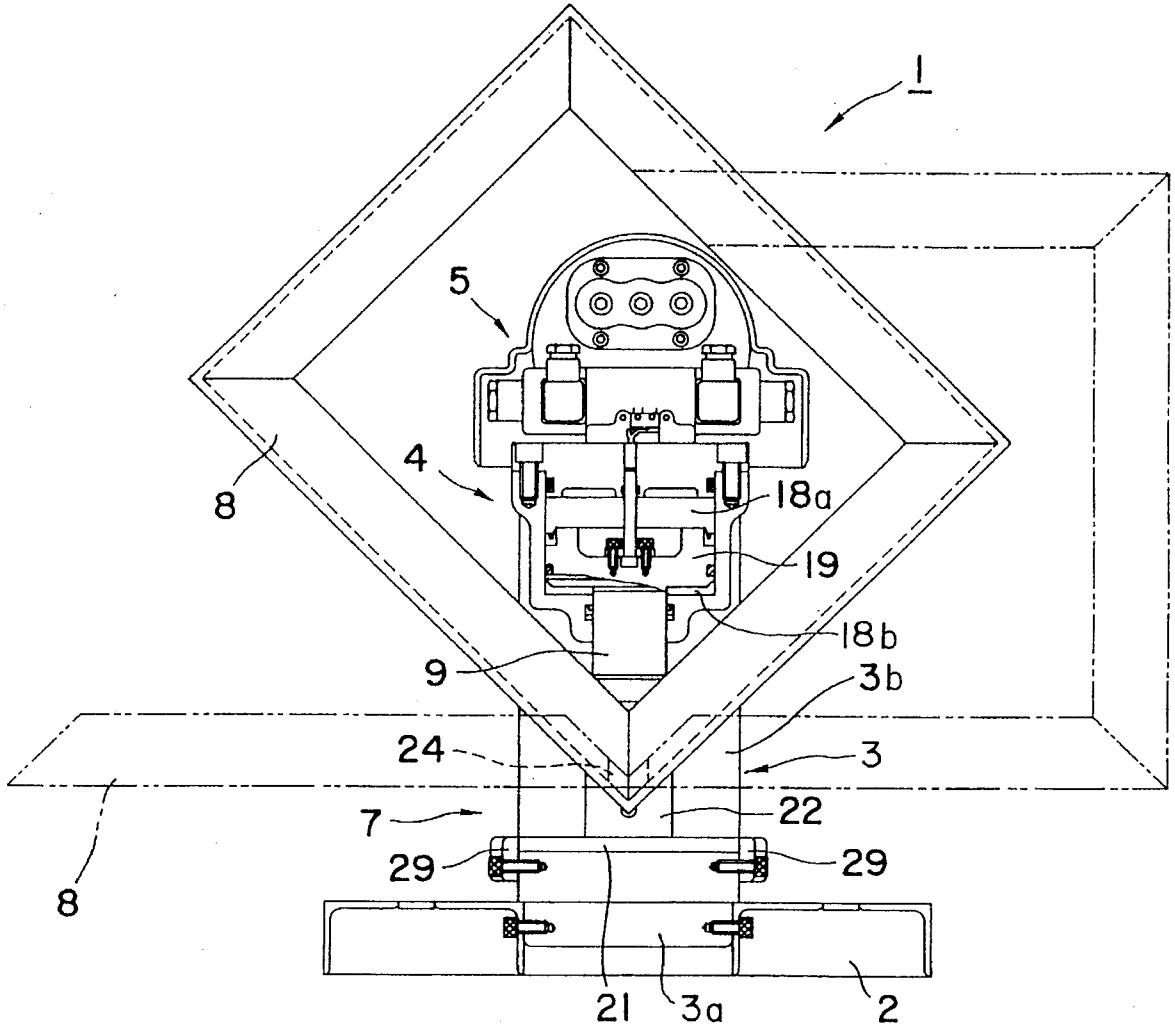
FIG. 2 is a section taken along the line II—II in FIG. 1, the punch press being shown together with an L sectioned steel strip being bent into a rectangular frame.

The portable, power driven punch press according to the invention is shown in one preferred form thereof in FIGS. 1 and 2 and therein generally designated 1. Broadly, the representative punch press 1 comprises a bed 2 laid horizontally, a C frame 3 erected on the bed, a double acting hydraulic cylinder 4 mounted fast to the C frame 3 and spaced upwardly from the bed 2, a hydraulic pump 5 mounted directly upon the cylinder 4 for supplying pressurized fluid thereto, an electric drive motor 6 coupled directly to the pump 5, and a die assembly 7 replaceably mounted between bed 2 and cylinder 4.

The replaceable die assembly 7 is herein shown as that for right angularly bending an L sectioned steel strip 8. This and other different die assemblies may be prepared for interchangeable use with the punch press 1. The bending die assembly 7, as well as cutting and notching die assemblies, will be later shown and described in detail by way of examples of all such interchangeable die assemblies.

The C frame 3 is so named because it is shaped like the letter "C" as seen in a side view as in FIG. 1. More specifically, the C frame 3 is a one piece construction of a die mount 3*a* bolted directly to the bed 2, a column 3*b* extending upwardly from the die mount, and an overarm 3*c* extending horizontally from the top end of the column into a parallel spaced relation with the die mount. The hydraulic cylinder 4 is built into the overarm 3*c*, with its piston rod 9 extending downwardly therefrom for acting on the die assembly 7 on the die mount 3*a*.

Hereinafter in this specification the directional terms such as "front" and "rear", and "forward" and "rearward" will be used with the understanding that the front side of the punch press 1 is shown directed to the left in FIG. 1 and toward the viewer in FIG. 2. Thus, for example, the column 3*b* of the C frame 3 extends upwardly from the rear end of the die mount 3*a*, and the overarm 3*c* extends forwardly from the top end of the column. It will be appreciated that thanks to this C frame 3, the blank 8 can be readily loaded on and unloaded from the punch press 1 from its front side, no matter how long it may be.

FIG. 1 indicates that the drive motor 6 is disposed rearwardly of the pump 5, with its axis of rotation extending horizontally, instead of vertically as in the noted prior art. The armature shaft 10 of the drive motor 6 extends into the casing 11 of the pump 5 for driving its pumping means 13 and hence for causing the same to supply a hydraulic fluid, normally oil, from a reservoir 12 into the hydraulic cylinder 4. The pumping means 13 is shown to comprise a rotary cam 14 formed on an extension of the motor armature shaft 10, a piston 15 reciprocated by the cam 14, a check valve 16 which is loaded by a spring 17 to hold normally closed the fluid passageway to the cylinder 4.

The cylinder 4 has a piston 19 slidably but pressure tightly mounted therein, thereby dividing its interior into a pair of opposed fluid chambers 18*a* and 18*b*. These fluid chambers communicate with the pump 5 via a directional control valve 20 whereby the pressurized fluid from the pump is directed into either of the fluid chambers for moving the piston 19, together with the piston rod 9 depending therefrom, up and down relative to the frame overarm 3*c*. The piston rod 9 when lowered acts directly on the die assembly 7 for causing the same to bend the blank 8 in a manner yet to be described.

Figure 3:
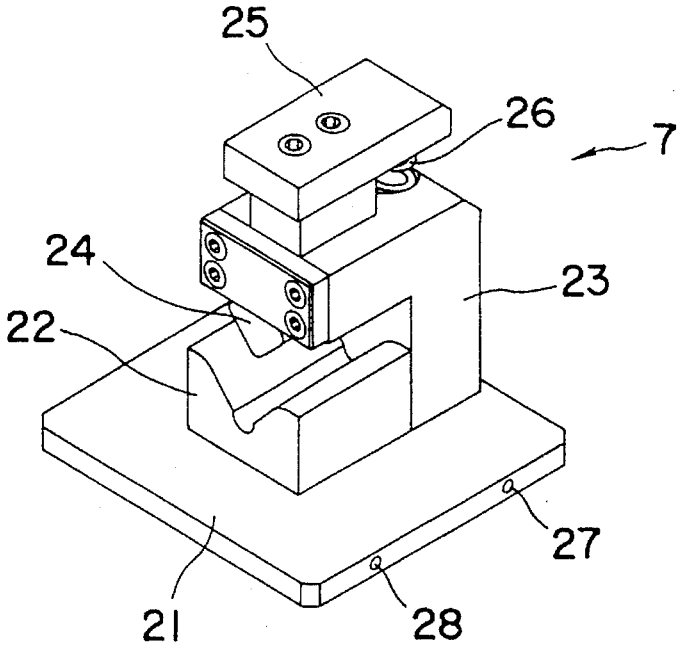
FIG. 3 is an enlarged perspective view of a bending die assembly used in the punch press of FIGS. 1 and 2.
Figure 4:
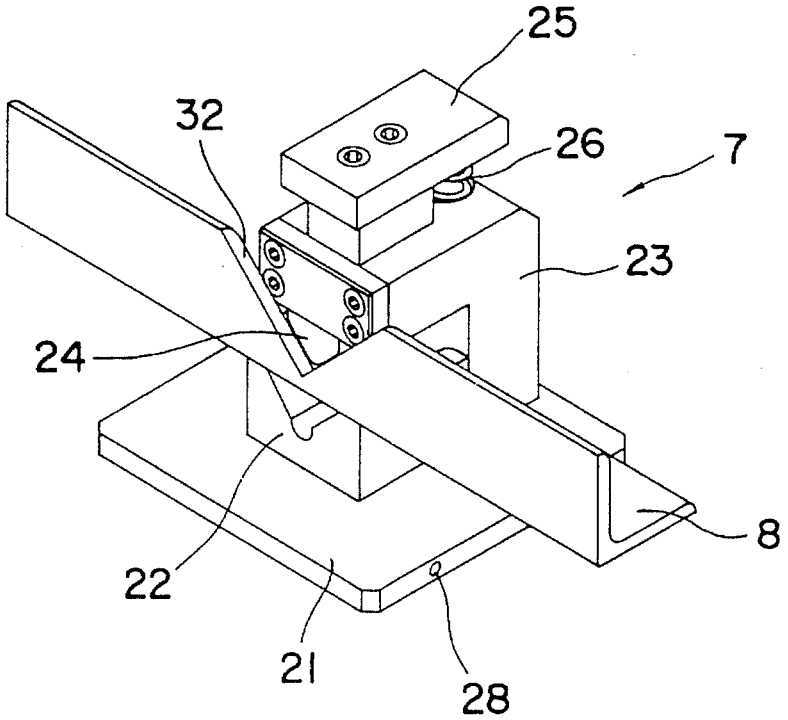
FIG. 4 is a view similar to FIG. 3 but showing the die assembly together with a steel strip to be bent.

Although the die assembly 7 appears in both FIGS. 1 and 2, it is better illustrated on an enlarged scale in FIGS. 3 and 4. The die assembly 7 includes a flat die shoe 21 on which there are fixedly mounted a bottom or female die 22 and an top die support 23 which is in the shape of an inverted L as seen in a side view as in FIG. 1. A top or male die 24 is slidably supported by the die support 23 for up and down movement into and out of mating engagement with the bottom die 22 via the blank 8. The top die 24 has an abutment 25 fastened to its top end for receiving the thrust of the piston rod 9. Acting between die support 23 and abutment 25, a helical compression spring 26 normally holds the top die 24 away from the bottom die 22 as shown in FIG. 3. This figure also reveals a pair of sockets 27 and 28 formed in at least one side edge of the die shoe 21.

With reference back to FIGS. 1 and 2 the die assembly 7 of the foregoing construction is positioned on the die mount 3*a* with its die shoe 21 confined between a pair of guide strips 29 fastened to the opposite sides of the die mount. At least one of the guide strips 29 has a ball 30 and a thumb screw 31 mounted thereto. The ball 30 becomes engaged in the socket 27 in the die shoe 21 when the die assembly 7 is positioned on the die mount 3*a* between the pair of guide strips 29. The mounting of the die assembly 7 is completed simply as the thumb screw 31 is subsequently tightened into engagement in the other socket 28 in the die shoe 21.

In use of the punch press 1 of the foregoing construction, with the bending die assembly 7 mounted thereto and with the L sectioned steel strip 8 as a blank, this steel strip may be placed between the dies 22 and 24 of the die assembly, as pictured in FIG. 4. It will be noted from this figure that the steel strip 8 has a preformed notch 32, at which the strip is to be bent into a right angle in a manner explained hereafter. The placement of the blank between the dies 22 and 24 will be easy, not matter how long it may be, because the C frame 3 leaves open not only the front, but also both sides, of the machine.

Then the drive motor 6 may be set into rotation. Revolving with the drive motor armature shaft 10, the cam 14 of the pump 5 will reciprocate the piston 15. The fluid in the reservoir 12 will thus be delivered under pressure into the upper fluid chamber 18*a* of the cylinder 4 via the check valve 16 and direction control valve 20. The result will be the descent of the piston 19 with the piston rod 9, which will act on the abutment 25 of the die assembly 7 for depressing the top die 24 against the force of the compression spring 26. Forced against the bottom die 22 by the top die 24, the steel strip 8 will be bent into a right angle at the notch 32.

The directional control valve 20 will place the upper fluid chamber 18*a* out of communication with the pump 5 and, instead, the lower fluid chamber 18*b* in communication therewith when the piston 19 reaches the bottom extremity of its stroke. Then the piston 19 will ascent with the piston rod 9, permitting the top die 24 to travel away from the bottom die 22 under the bias of the compression spring 26.

One cycle of bending operation has now been completed. The same cycle may be repeated on three ether notched parts of the steel strip 8 for bending the same into a rectangular frame depicted by the solid lines in FIG. 2.

FIG. 2 also reveals a pronounced advantage gained by the invention. The vertical dimension of the punch press 1 is greatly reduced by the arrangement of the pump 5 and drive motor 6 about a common horizontal axis and with the drive motor disposed behind the pump. Consequently, the steel strip 8 can be bent into a rectangular frame of much smaller size than heretofore without interference with upper part of the machine.

Figure 5:
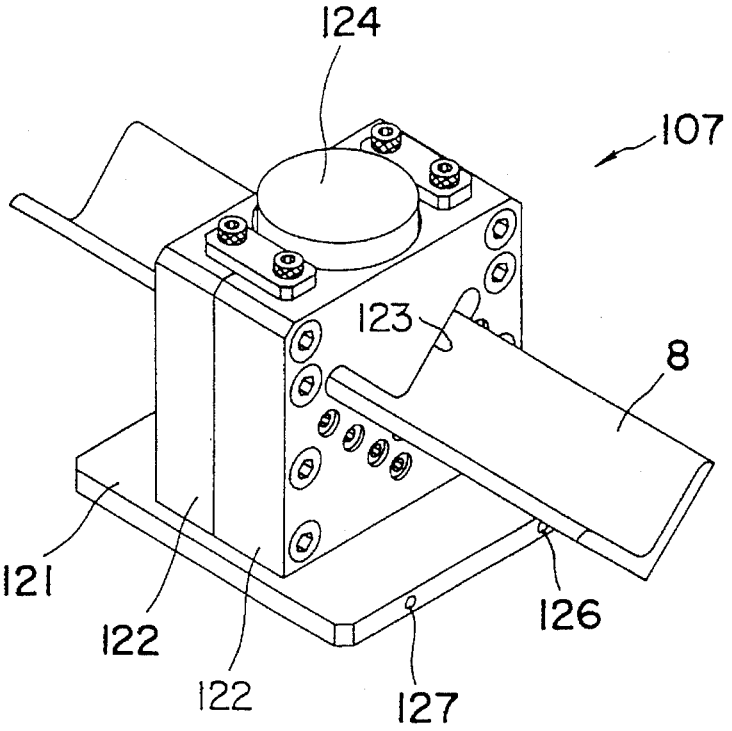
FIG. 5 is a perspective view of a cutting die assembly for interchangeable use with the bending die assembly, the cutting die assembly being shown together with a steel scrip to be cut.
Figure 6:
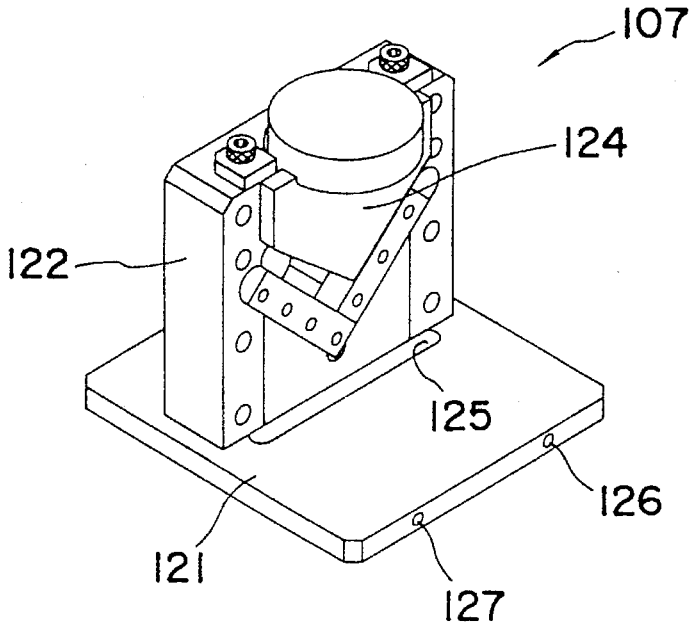
FIG. 6 is a view similar to FIG. 5 except that one of the split die sections is not shown to clearly reveal other parts.
Figure 7:
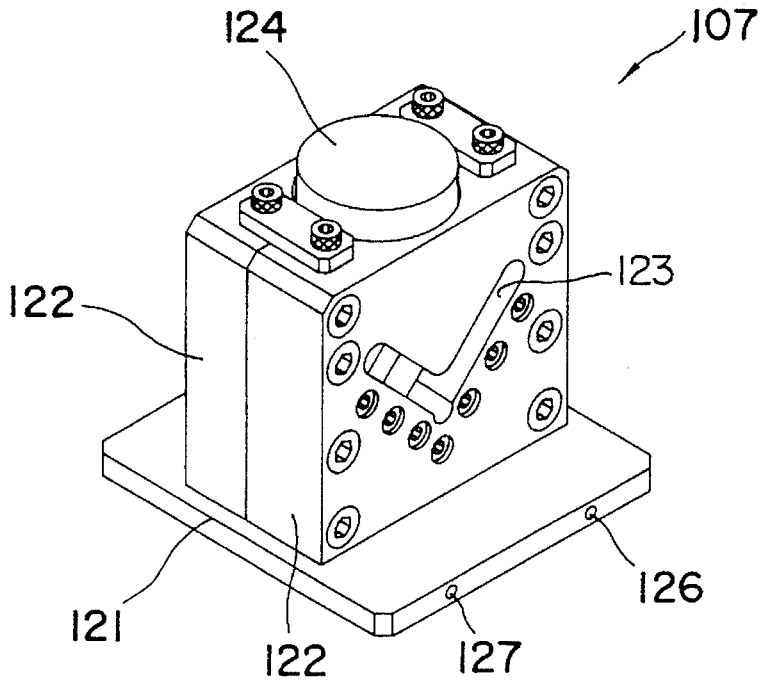
FIG. 7 is a view also similar to FIG. 5 except that the steel strip is not shown.
Figure 8:
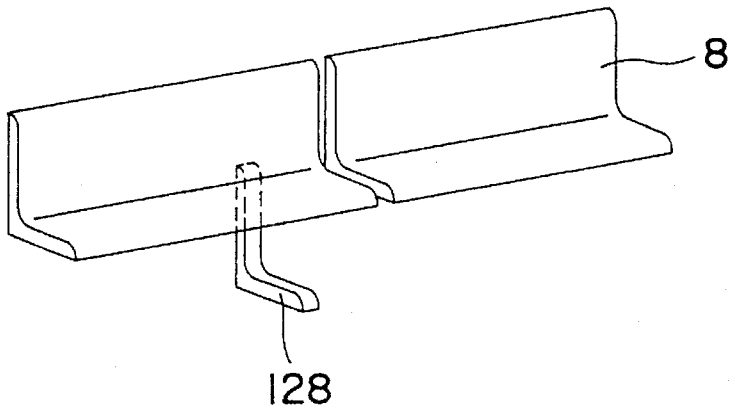
FIG. 8 is a perspective view of the steel strip that has been cut by the FIGS. 5–7 cutting die assembly.

FIGS. 5–7 illustrate a cutting die assembly 107 interchangeable with the bending die assembly 7 for use with the punch press 1. The cutting die assembly 107 has a die shoe 121 of the same shape and size as the die shoe 21 of the bending die assembly 7, complete with the pair of sockets 126 and 127. Fixedly mounted on the die shoe 121 are a pair of split die sections 122 each having a V shaped opening 123 formed transversely therethrough for receiving the L sectioned steel strip 8. A cutting die or punch 124 is slidably received between the fixed die sections 122. It is understood that the cutting die 124 is sprung upwardly of the fixed die sections 122. FIG. 6 reveals a slot 125 formed in the die shoe 121 for the discharge of a punching 128, FIG. 8, created as the blank is cut.

It is self evident from the foregoing that the cutting die assembly 107 can be mounted to the punch press 1 of FIGS. 1 and 2 just like the bending die assembly 7. The blank 8 to be cut may then be inserted in and through the openings 123 in the fixed die sections 122. The blank 8 will be cut as in FIG. 8 as the piston rod 9 forces the cutting die 124 down into the fixed die sections 122 against the force of the unshown spring.

Figure 9:
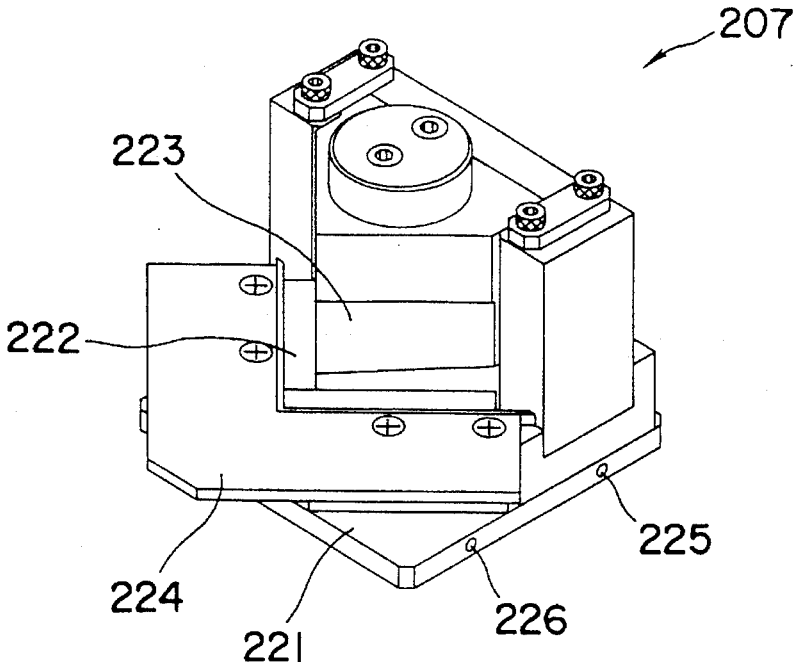
FIG. 9 is a perspective view of a notching die assembly for interchangeable use wit the bending die assembly.
Figure 10:
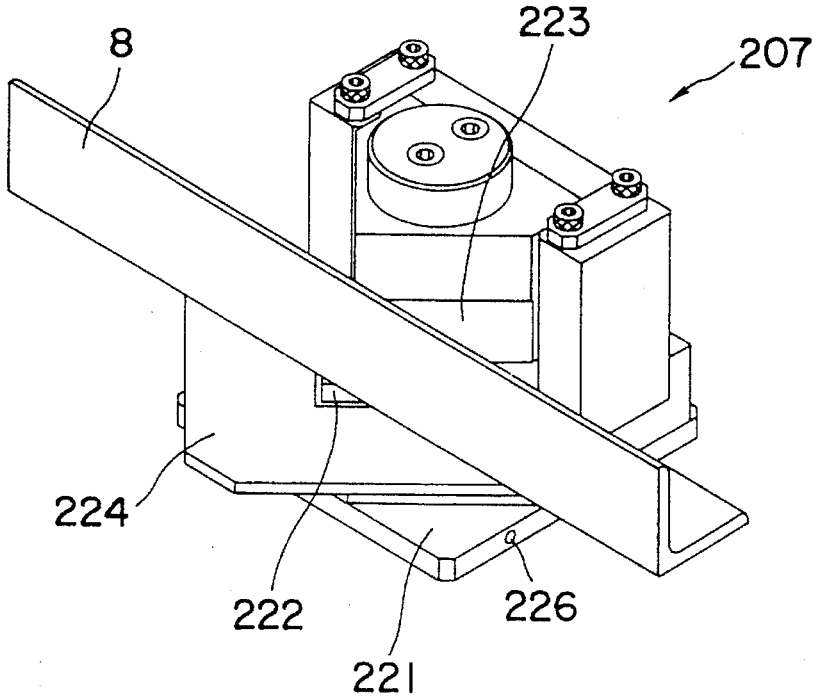
FIG. 10 is a view similar to FIG. 9 but showing the notching die assembly together with a steel strip being notched.
Figure 11:
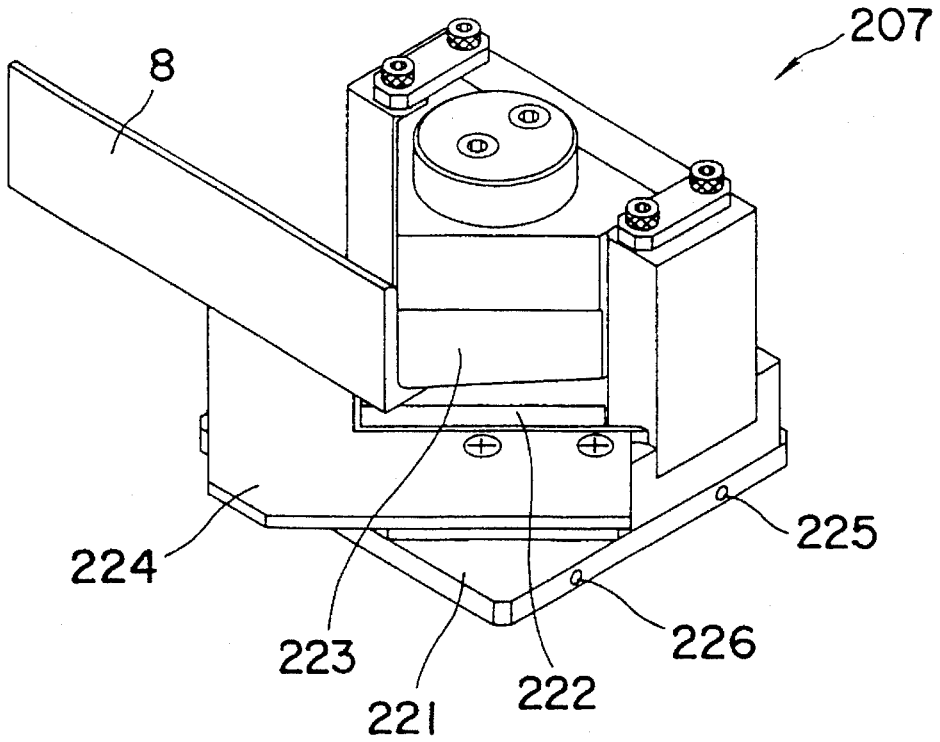
FIG. 11 is a view also similar to FIG. 9 but showing how a steel strip is chamfered, instead of being notched, by the notching die assembly.

Shown in FIGS. 9–11 is still another die assembly 207 suitable for use with the punch press 1. Intended primarily for notching and chamfering L shaped steel strips, the die assembly 107 has a die shoe 221 of the same shape and size as the die shoe 21 of the bending die assembly 7, complete with the pair of sockets 225 and 226. The die shoe 221 has mounted thereon a fixed die 222 and a cutting die or punch 223 movable up and down relative to the fixed die. Also mounted on the die shoe 221 is a blank rest 224 fixedly mounted on the die shoe 221 and disposed just forwardly of the fixed die 222. It is understood that the cutting die 223 is sprung upwardly of the fixed die 222, and that the die shoe 221 has an opening formed therein for the discharge of punchings.

Figure 12:
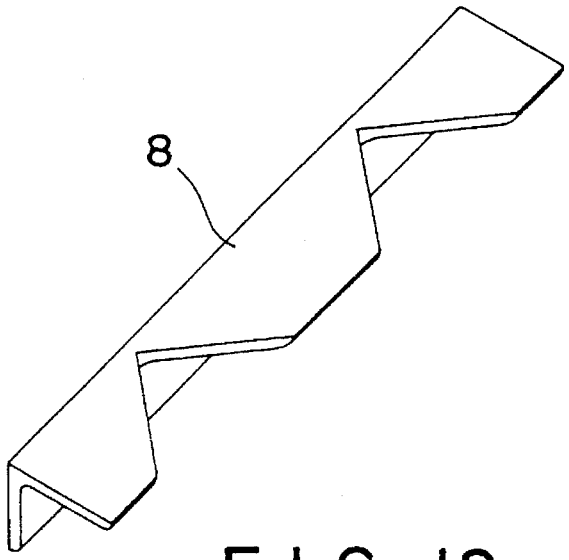
FIG. 12 is a perspective view of the steel strip that has been notched by the notching die assembly as in FIG. 10.
Figure 13:
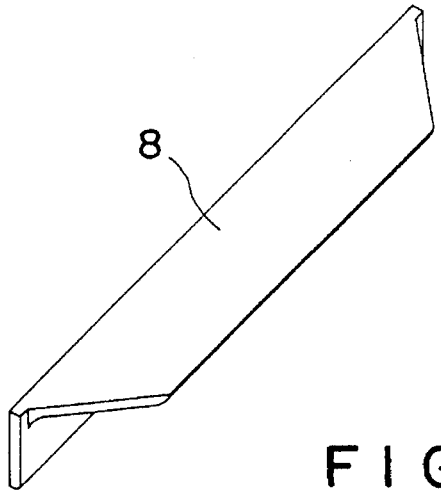
FIG. 13 is a perspective view of the steel strip that has been chamfered by the notching die assembly as in FIG. 11.
Figure 14:
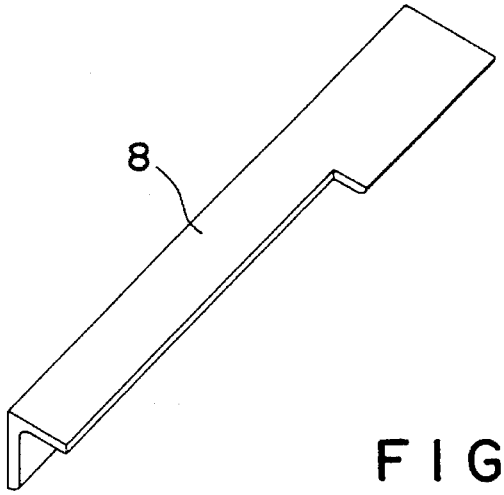
FIG. 14 is a perspective view of a steel strip that has been recessed by an additional die assembly for use with the FIG. 1 punch press.
Figure 15:
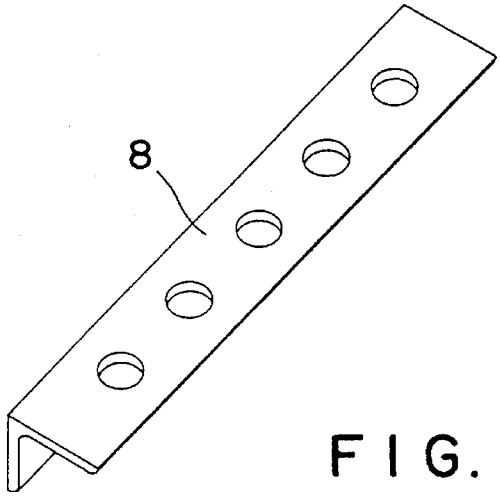
FIG. 15 is a perspective view of a steel strip that has been perforated by an additional die assembly for use with the FIG. 1 punch press.
Figure 16:
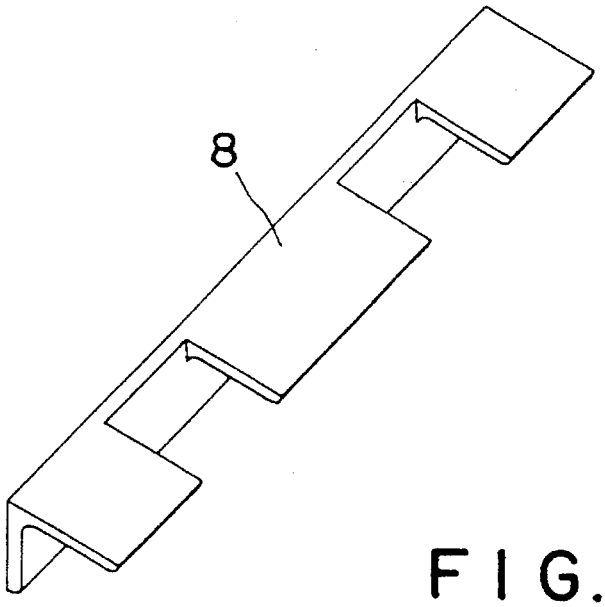
FIG. 16 is a perspective view of a steel strip that has been recessed by an additional die assembly for use with the FIG. 1 punch press.
Figure 17:
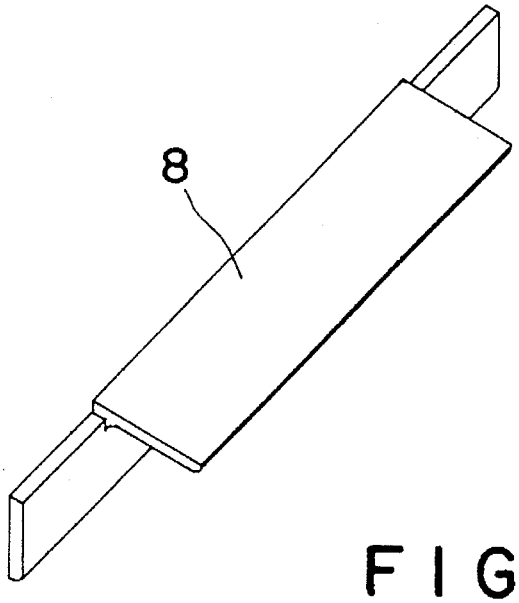
FIG. 17 is a perspective view of a steel strip that has been recessed differently by the same die assembly as in FIG. 16.

The blank 8 may be positioned on the blank rest 224 after mounting the die assembly 207 to the punch press 1. The die assembly 207 will create notches in the blank 8, as shown in FIG. 12, if the blank is positioned relative to the die assembly as in FIG. 10, and will chamfer the blank, as shown in FIG. 13, if the blank is positioned relative to the die assembly as in FIG. 11.

Various other die assemblies may be prepared for interchangeable use with the punch press 1. FIGS. 14–17 show examples of products made by such additional die assemblies.

Figure 18:
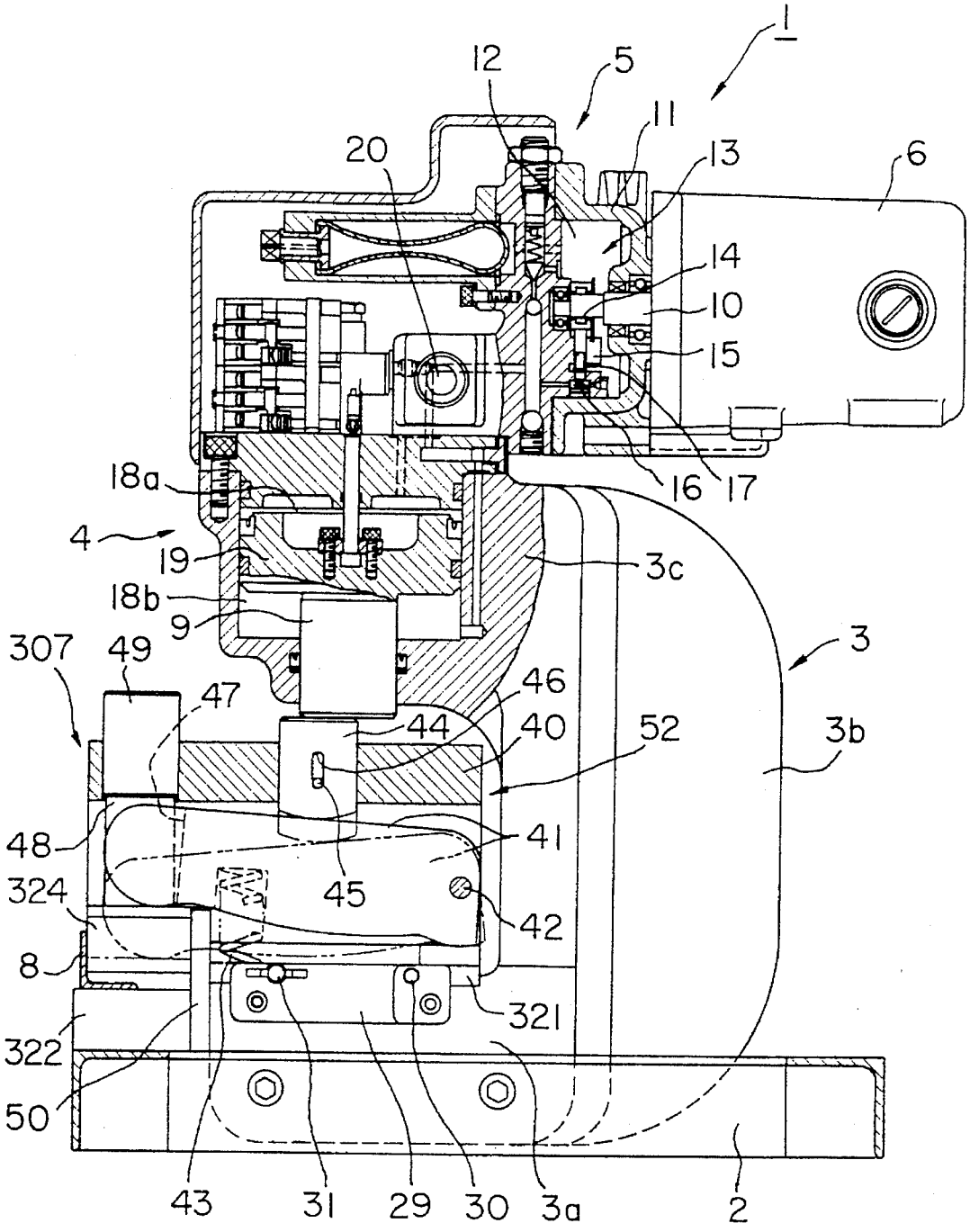
FIG. 18 is a side elevation, partly sectioned for clarity, of a punch press similar to that of FIG. 1 but incorporating a different bending die assembly the complete machine being shown in its normal state.
Figure 19:
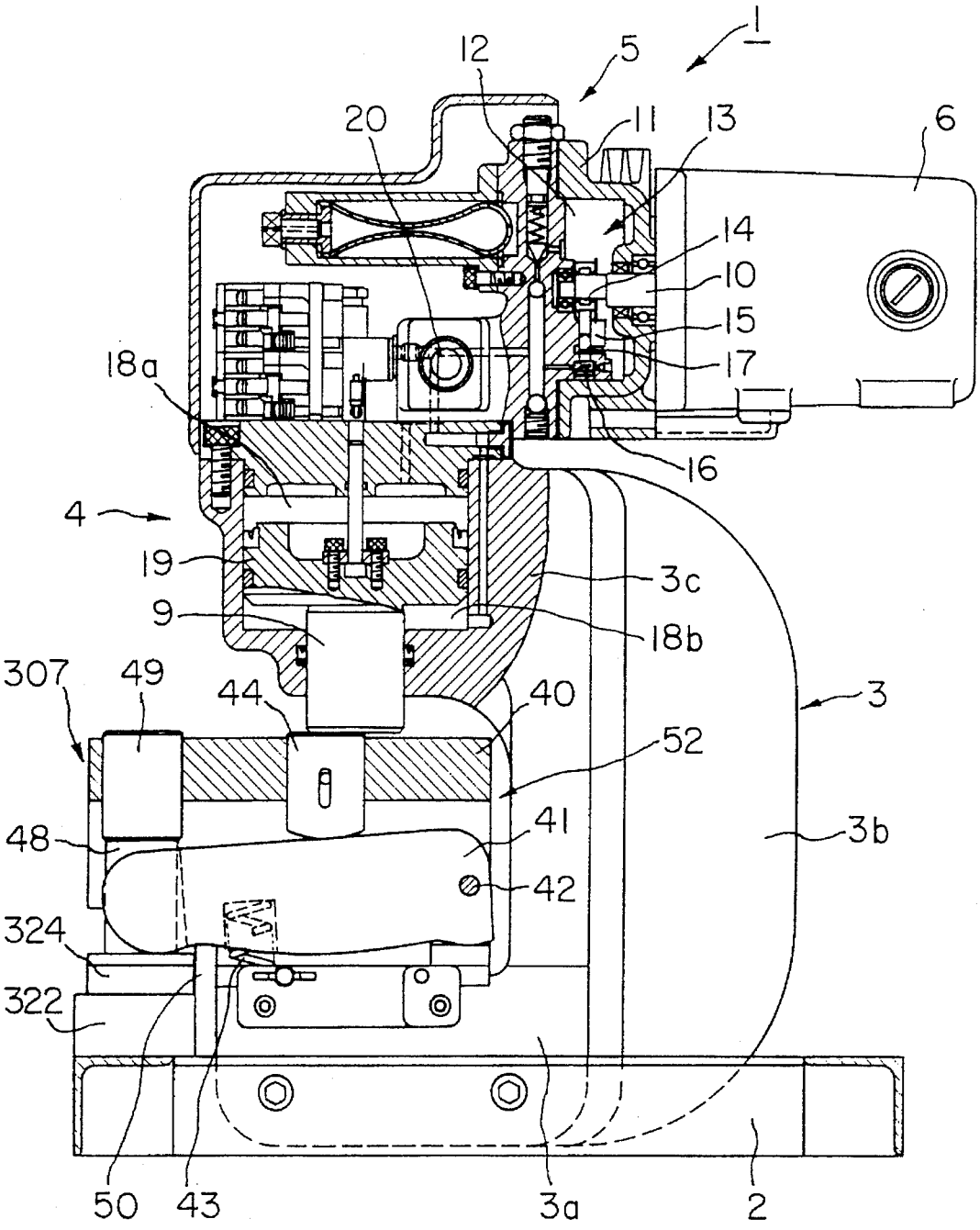
FIG. 19 is a view similar to FIG. 18 except that the machine is shown in the act of punching.

FIGS. 18 and 19 show the punch press 1 together with a bending die assembly 307 which, unlike all the preceding die assemblies, incorporates a drive linkage designed to enable the punch press to form a rectangular frame of still smaller size, much smaller, indeed, than the total height of the machine. The punch press itself can be analogous in construction to that shown in FIGS. 1 and 2, so that only the die assembly 307 will be described in detail.

Figure 20:
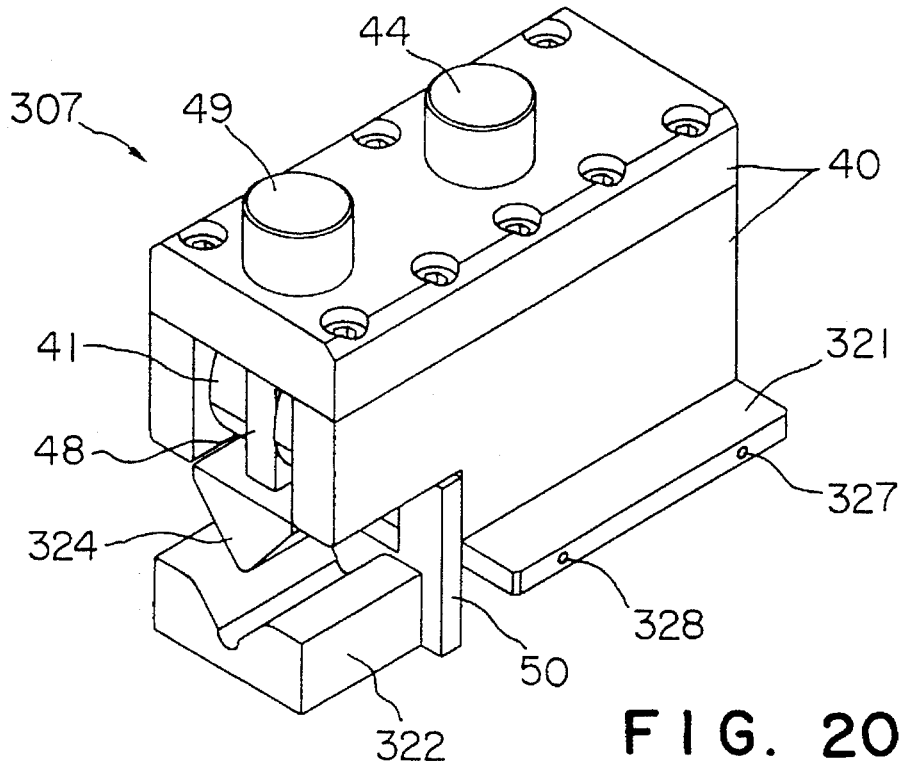
FIG. 20 is an enlarged perspective view of the FIGS. 18 and 19 bending die assembly.
Figure 21:
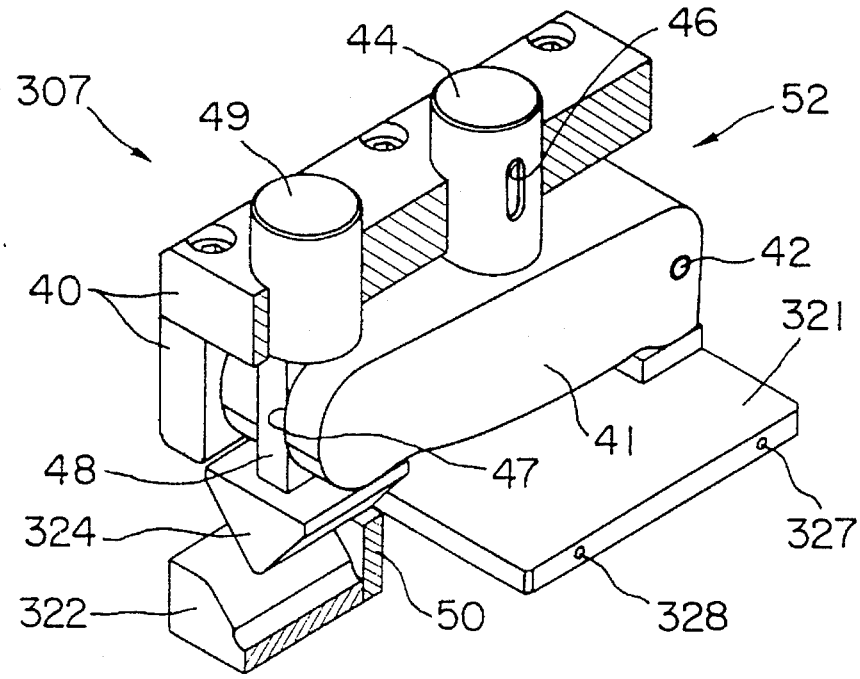
FIG. 21 is a view similar to FIG. 20 except that the die assembly is shown partly broken away to reveal the inner details.
Figure 22:
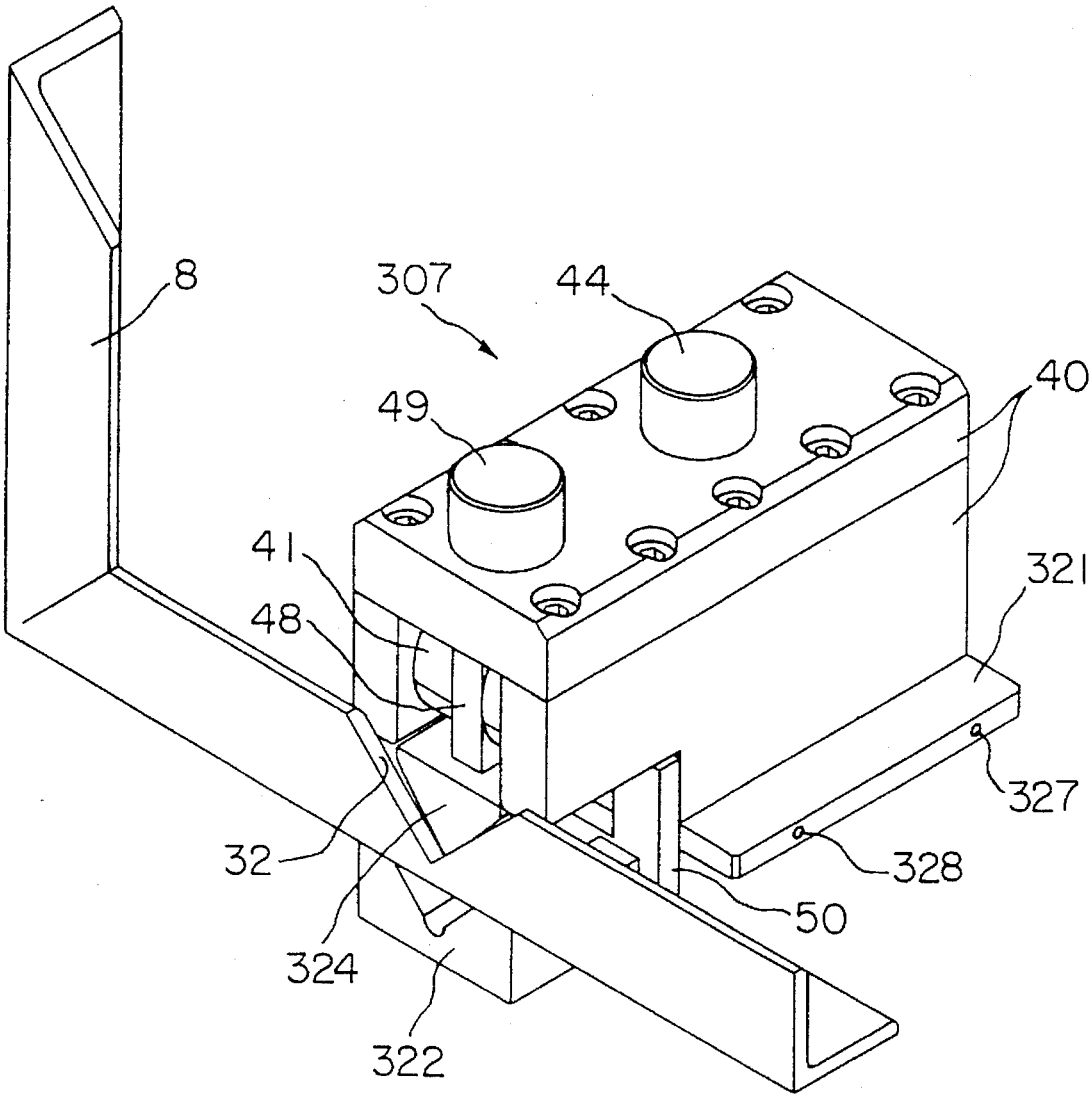
FIG. 22 is a view also similar to FIG. 20 except that the die assembly is shown together with a blank to be bent.

As illustrated on an enlarged scale in FIGS. 20–22, the bending die assembly 307 has a mounting plate 321 similar to the die shoe 21 of the bending die assembly 7, complete with a pair of sockets 327 and 328 formed in each lateral edge thereof. The mounting plate 321 has immovably formed thereon a guide frame 40 which is shaped like an inverted U in cross section, providing a hollow extending in the front to rear direction of the punch press 1.

Within the guide frame 40 a drive arm 41 is pinned at 42 on the mounting plate 321. Extending forwardly of the punch press 1 from its pinned end, the drive arm 41 is pivotable in a vertical plane and is biased upwardly by a helical compression spring seen at 43 in FIGS. 18 and 19. A ram 44 slidably extends through an opening in the top of the guide frame 40 and is thereby constrained to vertical displacement. A key 45, FIG. 18, is slidably engaged in a keyway 46 in the ram 44 to prevent its detachment from the guide frame 40. The ram 44 is to be depressed by the piston rod 9 of the hydraulic cylinder 4 for pivoting the drive arm 41 downwardly against the force of the compression spring 43.

The drive arm 41 has a recess 47 cut in its front or free end for engaging a die support 48 with clearance. The die support 48 carries a top die 324 on its bottom end and has its top end coupled to a slide 49 of cylindrical shape slidably extending through another opening in the top of the guide frame 40. A bottom die 322 is disposed under the top die 324 by being secured to the mounting plate 321 via a U shaped support member 50. The slide 49 serves to constrain the top die 324 to up and down movement into and out of mating engagement with the bottom die 322 in response to the pivotal motion of the drive arm 41.

It will thus be understood that the thrust of the piston rod 9 is transmitted to the top die 324 by the drive linkage 52 comprising the ram 44 and drive arm 41. Generally elongated horizontally, the drive linkage 52 makes it possible to dispose the dies 322 and 324 in a position displaced forwardly from under the hydraulic cylinder 4 and the pump 5 thereon. No interfering part exists in the space over the exposed front part of the die assembly 307.

The die assembly 307 may be mounted to the punch press 1 by placing its mounting plate 321 on the die mount 3*a* of the C frame 3 and between the pair of guide strips 29 so as to receive the balls 30 in the mounting plate sockets 327. The mounting of the die assembly 307 is completed as the thumb screws 31 on the guide strips 29 are subsequently tightened into engagement in the mounting plate sockets 328.

Thus mounted to the punch press 1, the die assembly 307 will have its drive arm 41 raised under the bias of the compression spring 43, as indicated by the solid lines in FIG. 18, holding the top die 324 away from the bottom die 322. The blank 8 may now be positioned between the dies 322 and 324 as shown in FIG. 22. With the rotation of the drive motor 6, the piston rod 8 of the hydraulic cylinder 4 will be thrust down, as has been explained with reference to FIG. 1. This thrust will be transmitted to the top die 324 via the ram 44 and drive arm 41 against the force of the compression spring 43, as depicted in FIG. 19.

Figure 23:
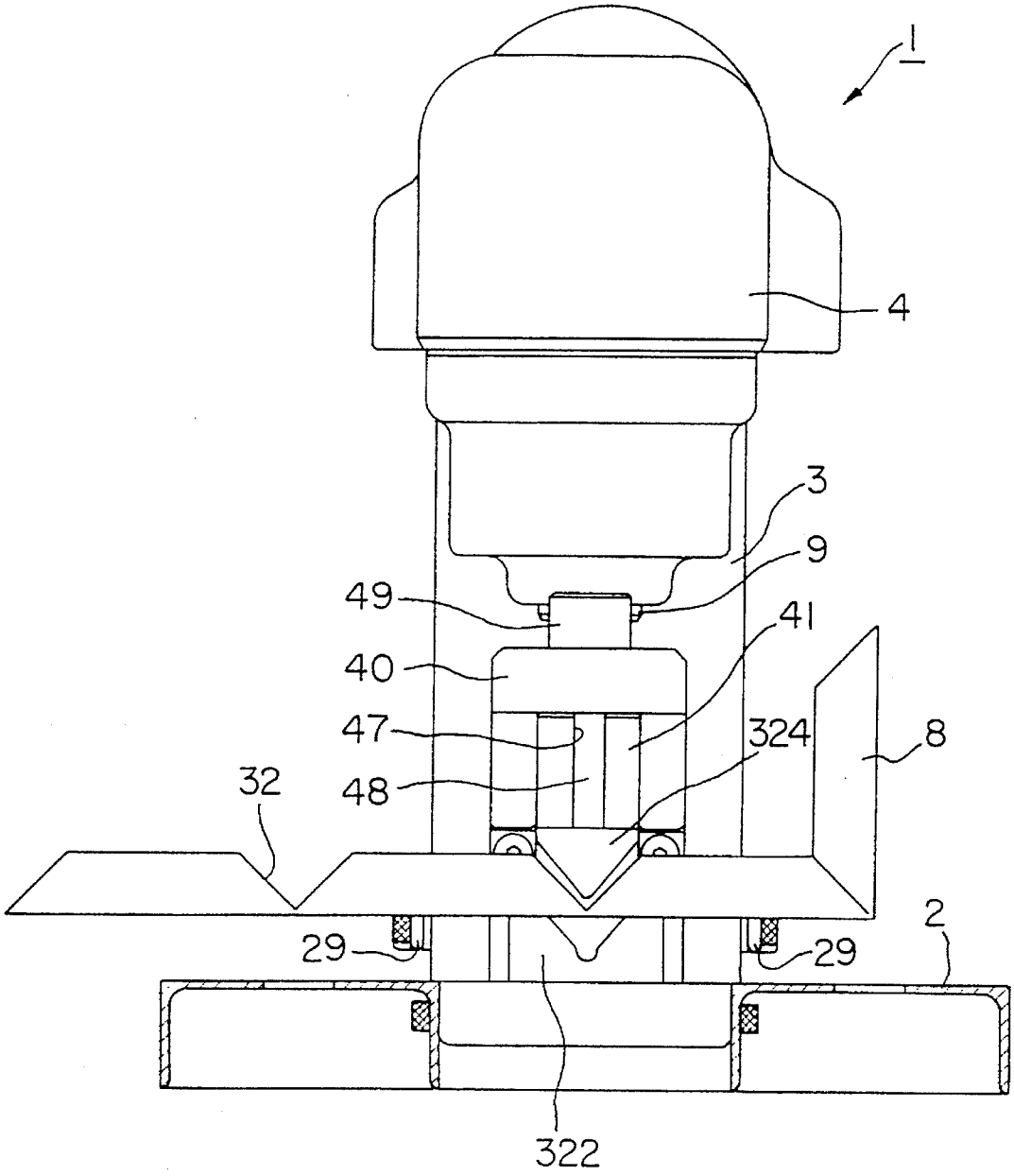
FIG. 23 is a front elevation of the FIGS. 18 and 19 machine shown together with a notched steel strip being bent into a rectangular frame.
Figure 24:
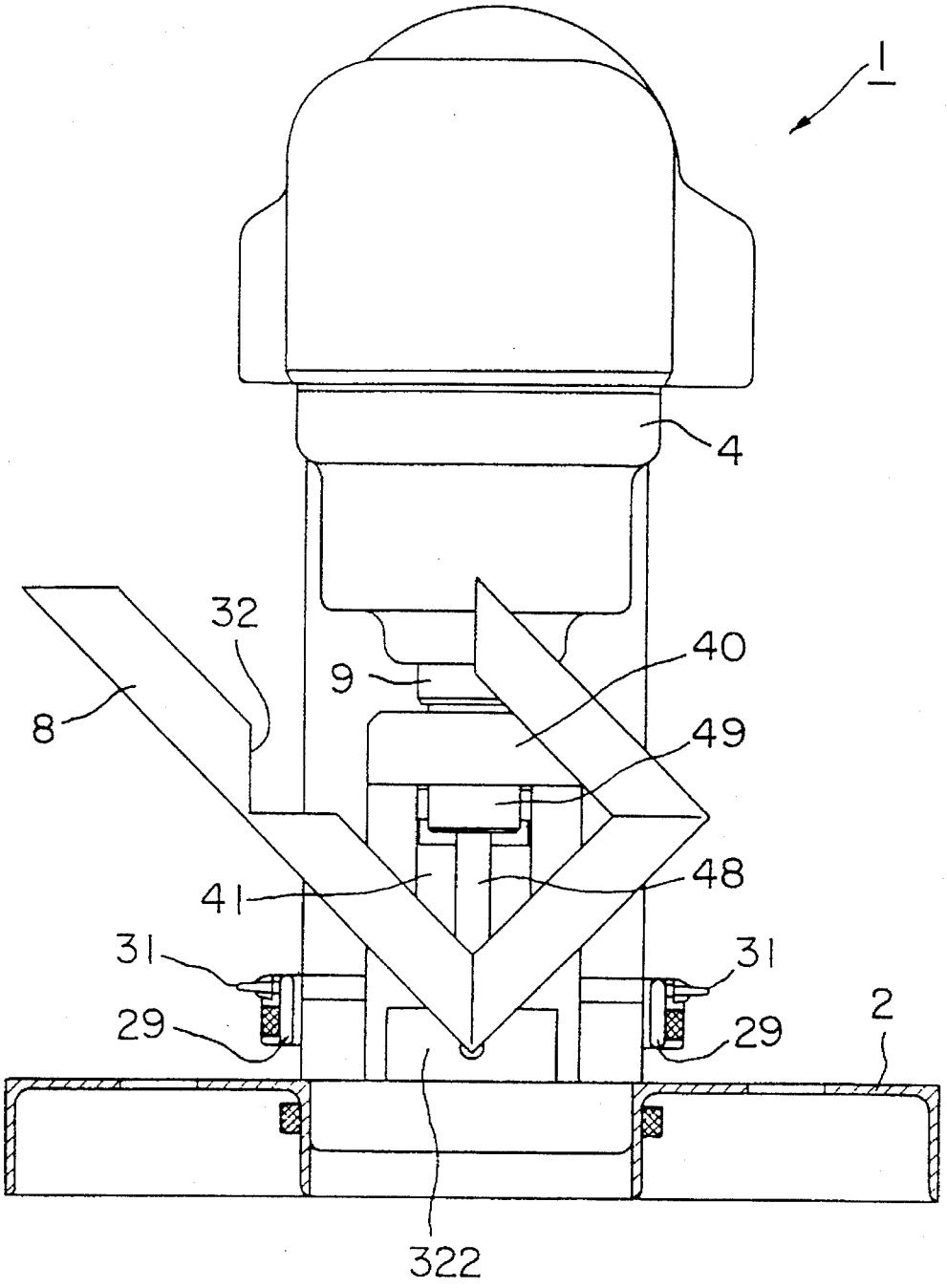
FIG. 24 is a view similar to FIG. 23 but showing the machine in another state of bending the steel strip into a rectangular frame.
Figure 25:
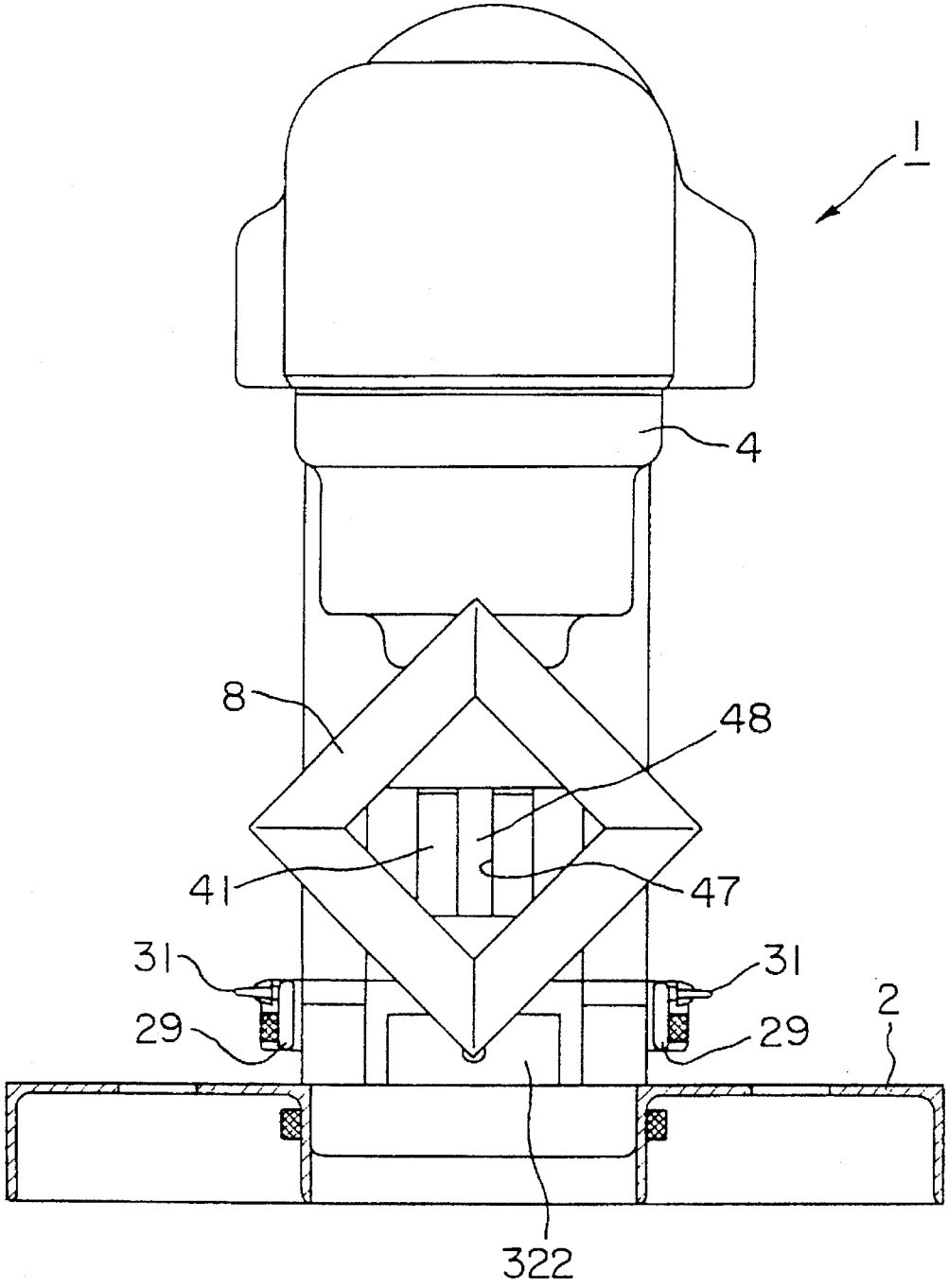
FIG. 25 is also a view similar to FIG. 23 but showing the machine upon completion of bending the steel strip into a rectangular frame.

FIGS. 23–25 are explanatory of how the L sectioned steel strip 8, having the preformed notches 32, are bent into a rectangular frame by the repetition of the foregoing cycle of bending operation. It will be appreciated that the internal size of the frame is limited only by the height of the die assembly 307, not by the height of the punch press 1. A comparison of FIG. 25 with FIG. 2 will reveal that the frame formed by use of the die assembly 307 is far less in size than that made by use of the die assembly 7.

Notwithstanding the foregoing detailed disclosure, it is not desired that the present invention be limited by the exact details of the illustrated embodiment. For example, instead of the C frame 3, only the column 3*b* could be erected on the bed 2, and the hydraulic cylinder 5 could be mounted overhangingly to the column. Any of the die assemblies might then be mounted directly on the bed. It will also be apparent that the bending die assembly 307, incorporating the drive linkage 52, is readily modifiable for cutting, notching, perforating, and a variety of other operations. All these and other modifications, alterations and adaptions of the invention are intended in the foregoing disclosure. It is therefore appropriate that the invention be construed broadly and in a manner consistent with the fair meaning or proper scope of the appended claims.

What is claimed is:

1. A punch press for bending, cutting, boring, or otherwise working on blanks, comprising:

(a) frame means including a bed;

(b) a fluid actuated cylinder mounted above the frame means in overlying relationship to the bed and having a piston rod directed downwardly along an axis perpendicular to the bed;

(c) pump means disposed atop the fluid actuated cylinder for supplying pressurized fluid thereto, the pump means being generally disposed parallel to the bed for reduction of the total height of the punch press said pump means comprising:

(1) a drive motor having an axis of rotation extending horizontally; and (2) a pump directly overlying the fluid actuated cylinder and directly coupled to the drive motor thereby to be driven for supplying pressurized fluid to the fluid actuated cylinder; and (d) die means mounted on the bed in order to be acted upon by the piston rod of the fluid actuated cylinder for working on a desired blank.

2. The punch press of claim 1 wherein the frame means further comprises:

(a) a column erected on the bed; and (b) an overarm extending from a top end of the column into overhanging relationship to the bed and supporting the fluid actuated cylinder.

3. The punch press of claim 2 wherein the frame means further comprises a die mount extending from a bottom end of the column in parallel spaced relationship to the overarm, the die mount being mounted to the bed for supporting the die means thereon.

4. The punch press of claim 1 wherein the die means is replaceable.

5. The punch press of claim 4 wherein the die means comprises a bending die assembly comprising:

(a) a die shoe to be replaceably mounted on the bed of the frame means;

(b) a bottom die fixedly mounted on the die shoe;

(c) a die support fixedly mounted on the die shoe; and (d) a top die slidably supported by the die support and adapted to be acted upon by the piston rod of the fluid actuated cylinder for movement working on a blank in coaction with the bottom die.

6. The punch press of claim 4 wherein the die means comprises a cutting die assembly comprising:

(a) a die shoe to be replaceably mounted on the bed of the frame means;

(b) a pair of split die sections fixedly juxtaposed on the die shoe and each having an opening extending therethrough for receiving a blank; and (c) a cutting die slidably received between the pair of split die sections and adapted to be acted upon by the piston rod of the fluid actuated cylinder for cutting the blank in co-action with the split die sections.

7. The punch press of claim 4 wherein the die means comprises a notching die assembly comprising:

(a) a die shoe to be replaceably mounted on the bed of the frame means;

(b) a fixed die fixedly mounted on the die shoe; and (c) a cutting die acted upon by the piston rod of the fluid actuated cylinder for working on a blank in coaction with the fixed die.

8. The punch press of claim 7 wherein the notching die assembly further comprises a blank rest fixedly mounted on the die shoe for holding a blank being cut.

9. The punch press of claim 1 further comprising a drive linkage for transmitting movement of the piston rod of the fluid actuated cylinder to the die means, the drive linkage being generally elongated parallel to the bed so that the die means is disposed out of vertical alignment with the fluid actuated cylinder.

10. The punch press of claim 9 wherein the drive linkage comprises:

(a) a drive arm pivotally supported at one end on the frame means and operatively engaged at another end with the die means; and (b) a ram disposed between the piston rod of the fluid actuated cylinder and the drive arm.

11. A punch press for bending, cutting, boring, or otherwise working on blanks, comprising:

(a) frame means including a bed;

(b) a fluid actuated cylinder mounted above the frame means in overlying relationship to the bed and having a piston rod directed downwardly along an axis perpendicular to the bed;

(c) pump means disposed atop the fluid actuated cylinder for supplying pressurized fluid thereto, the pump means being generally disposed parallel to the bed for reduction of the total height of the punch press said pump means comprising:

(1) a drive motor having an axis of rotation extending horizontally; and (2) a pump directly overlying the fluid actuated cylinder and directly coupled to the drive motor thereby to be driven for supplying pressurized fluid to the fluid actuated cylinder; and (d) a die assembly replaceably mounted on the bed, the die assembly comprising die means for working on a desired blank, and a drive linkage for transmitting movement of the piston rod of the fluid actuated cylinder to the die means, the drive linkage being generally elongated parallel to the bed so that the die means is disposed out of vertical alignment with the fluid actuated cylinder.

12. The punch press of claim 11 wherein the die means of the die assembly comprises a fixed die and a movable die, and wherein the die assembly further comprises:

(a) a mounting plate to be replaceably mounted on the bed of the frame means, the fixed die of the die means being fixedly mounted to the mounting plate;

(b) a guide frame fixedly mounted on the mounting plate;

(c) a slide carrying the movable die of the die means and slidably supported by the guide frame to enable the movable die to work on a blank in coaction with the fixed die;

(d) a drive arm pivotally supported at one end on the mounting plate and operatively engaged at another end with the movable die of the die means; and (e) a ram slidably supported by the guide frame, the ram being acted upon by the piston rod of the fluid actuated cylinder for acting, in turn, upon the drive arm in order to cause the movable die to work on a blank in coaction with the fixed die.

* * * * *